US007857158B2

(12) United States Patent
Wichelhaus

(10) Patent No.: US 7,857,158 B2
(45) Date of Patent: Dec. 28, 2010

(54) PLASTIC CONTAINER PROVIDED WITH AT LEAST ONE SUCTION CUP

(75) Inventor: Andre Wichelhaus, Weinstadt (DE)

(73) Assignee: IMV Innovation Marketing und Vertriebs GmbH, Stuttgart (DE)

( * ) Notice: Subject to any disclaimer, the term of this patent is extended or adjusted under 35 U.S.C. 154(b) by 772 days.

(21) Appl. No.: 10/556,632

(22) PCT Filed: May 17, 2004

(86) PCT No.: PCT/DE2004/001030

§ 371 (c)(1),
(2), (4) Date: Feb. 6, 2008

(87) PCT Pub. No.: WO2004/103838

PCT Pub. Date: Dec. 2, 2004

(65) Prior Publication Data

US 2008/0258035 A1 Oct. 23, 2008

(30) Foreign Application Priority Data

May 16, 2003 (DE) ..... 203 07 669 U

(51) Int. Cl.
*B65D 25/24* (2006.01)

(52) U.S. Cl. ..... 220/483

(58) Field of Classification Search ..... 220/23.91, 220/480, 483

See application file for complete search history.

(56) References Cited

U.S. PATENT DOCUMENTS

| | | | | | |
|---|---|---|---|---|---|
| 1,696,483 | A | * | 12/1928 | Hiering | 220/483 |
| 4,166,553 | A | * | 9/1979 | Fraterrigo | 222/181.2 |
| 4,793,517 | A | * | 12/1988 | Washut | 222/129 |
| 6,808,090 | B2 | * | 10/2004 | Pedersen | 222/181.3 |

FOREIGN PATENT DOCUMENTS

| | | | |
|---|---|---|---|
| DE | 1 835 736 | U1 | 7/1961 |
| DE | 37 11 858 | A1 | 8/1987 |
| DE | 90 01 543 | U | 5/1990 |
| DE | G 91 13 970.8 | | 11/1991 |
| DE | 198 26 371 | A1 | 6/1998 |
| DE | 201 00 052 | U1 | 1/2001 |
| DE | 201 07 912 | U | 8/2001 |
| DE | 201 19 528 | U1 | 10/2001 |
| DE | 100 51 539 | A | 5/2002 |
| GB | 2 318 777 | A | 5/1998 |

* cited by examiner

*Primary Examiner*—Harry A Grosso
(74) *Attorney, Agent, or Firm*—Schlee IP International, P.C.; Alexander R. Schlee

(57) ABSTRACT

The invention relates to a plastic container provided with at least one suction cup. Said container comprises a holding recess (15) arranged in a container wall (12) for the holding projection (16) of the suction cup, and also comprises a flat receiving trough (18) arranged around the holding recess. The suction cup can be elastically flattened with the suction cover thereof (19) in the receiving trough such that the suction cup is arranged in an essentially expanded manner in the receiving trough and establishes a flush seal with the external contour (34) of the container wall (12).

12 Claims, 7 Drawing Sheets

PLASTIC CONTAINER PROVIDED WITH AT LEAST ONE SUCTION CUP

RELATED APPLICATION

Figures 1, 2:
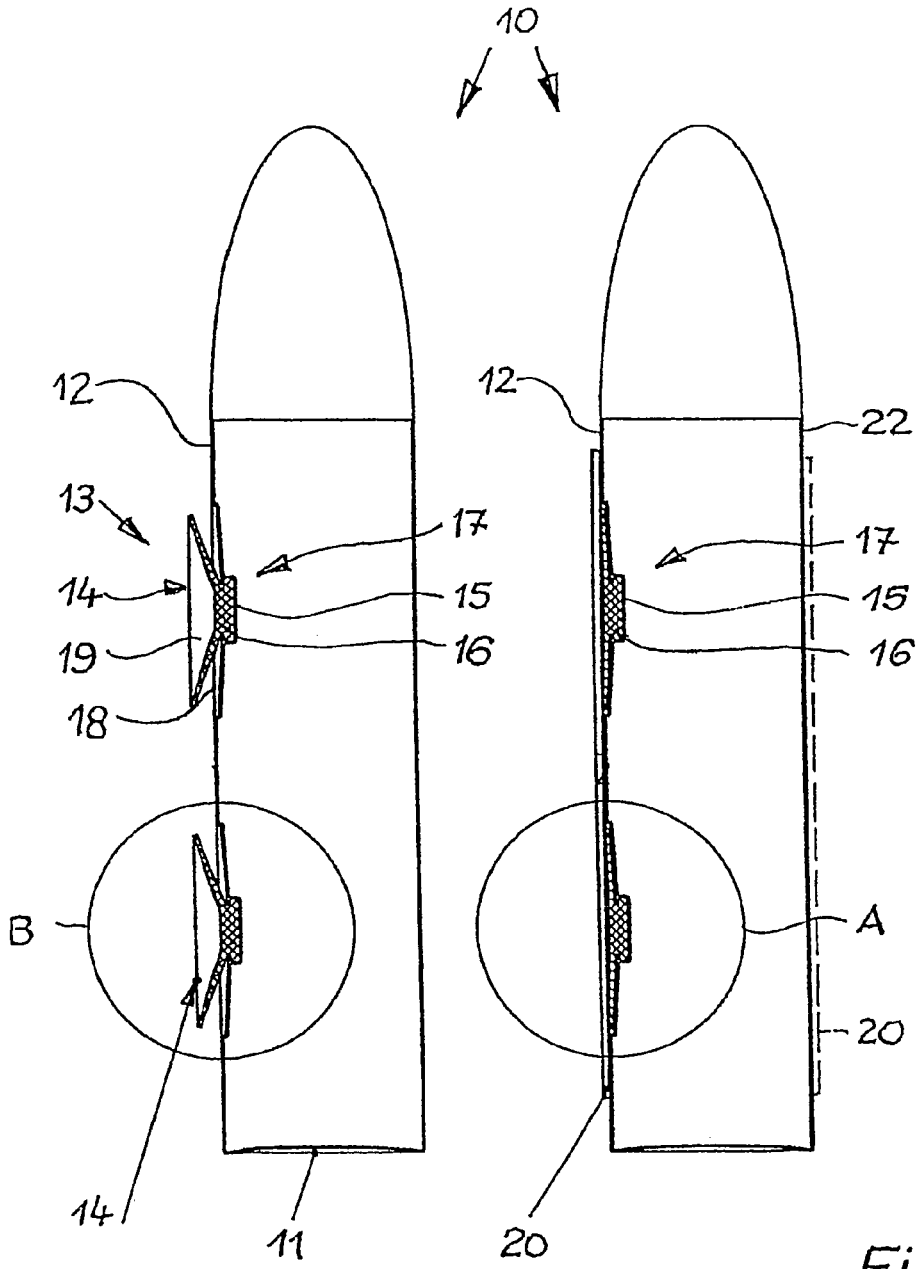

This application claims priority to German patent application 203 07 669.9 filed on 16 May 2003. This application is a US National Stage filing based on PCT/DE2004/001030.

The invention relates to a plastic container with at least one suction cup for attaching the container to a wall surface.

There are containers of different kinds, like bottles or tubes, for example for receiving washing-up liquid, household cleaners, shower gels, shampoos or the like, which are provided in various places for being used, for example in the household, in the kitchen and the bathroom or in hotels when travelling or also in mobile homes.

It is a disadvantage of such known containers that being relatively tall-sized they only offer a small surface to stand on and have thus a tendency to fall over. This happens mainly when a plurality of containers are stored together in a small space. Such a condition is for example given in the bathroom where soap or cosmetics bottles are placed on a shelf under the mirror, or are arranged on small boards in the shower.

Various suggestions have already been made to provide plastic bottles in a container wall with an undercut holding recess for the corresponding undercut holding projection at the external apex of a suction cup by means of which the container can be attached to a wall surface by suction (for example DE 201 07 912 U1, DE 1 835 736 U1). Another known plastic container with integrated suction cup (DE 90 01 543 U1) is provided with a hollow-spherical recess for the suction cup from the bottom of which a pin with a spherical head protrudes onto which a rubber suction cup can be slipped which is provided for this purpose with a hollow-spherical recess in its foot projection. The recess is meant to serve the embedding of the suction cup for optical and packaging reasons.

By the invention a plastic container with integrated suction cup is created the design of which is both user friendly and provides easy packing.

According to the invention a plastic container having a container wall with at least one suction cup for attaching said container to a wall surface is created. The suction cup, protruding from the external contour of the container wall when being used, has a concave inside formed by inner surfaces of a bottom wall and of a suction cover protruding therefrom, which suction cover expands in diameter from the inner surface of the bottom wall and can be elastically flattened. On the side of the inner surface facing away from the bottom wall a holding projection is formed which is fixed in a complementary, pocket hole type holding recess formed in the container wall. In the container wall a flat receiving trough is formed around the holding recess and the suction cover is designed such that it can be flattened into a packing position, spreading out into the flat receiving trough. The largeness of the receiving trough corresponds at least to the largeness of the spread-out suction cover and its depth to the depth of the suction cover, and the holding recess is set back from the external contour of the container wall to the effect that the inner surfaces of the bottom wall and of the spread-out suction cover substantially extend flush with the external contour of the container wall.

By means of the invention the suction cover can therefore be elastically spread-out into the flat receiving trough of the container wall so that the peripheral rim of said suction cover lies within the area of the receiving trough. As, moreover, the holding recess into which the holding projection engages at the external apex of the suction cup is formed at a distance from the external contour of the container wall at the bottom of the receiving trough, the bottom wall of the suction cup also engages in the receiving trough, so that the inner surface of the suction cup is an essentially flush continuation of the external contour of the container wall in the area of the receiving trough and does not protrude from the external contour when the suction cover spreads into the receiving trough.

In spread-out state of the suction cover the contour and the design of the essentially bottle-shaped plastic container are not interrupted. Moreover, when ready for being shipped, several containers can be stacked next to each other without the suction cup being in the way or enlarging the packing unit. Even though, however, the suction cup is immediately usable for the consumer without it being necessary to supply the suction cup separately and only install it into the receiving recess later on.

The container according to the invention, for example a bottle, a tube or the like, can be attached to any smooth surface, for example to the tiles in a shower, in any handy position. Just as this is the case with the known containers with integrated suction cup, this has the advantage that the container cannot fall over or to the ground, but is attached to the spot where it can be reached most easily. Containers according to the invention are preferably produced by plastic injection moulding or blow moulding.

If a container according to the invention is provided with several suction cups, the suction cups can be arranged in one common receiving trough. It is preferable, however, to provide a separate receiving trough according to the invention for each of the suction cups around the respective holding recess for the holding projection of the suction cup.

Even though the inner surface of the suction cover may be slightly concave along its generatrices, a conical design of the inner surface, and by the way also the external surface of the suction cover, with straight generatrices is preferred. The circular inner surface of the bottom wall of the suction cup is preferably plane.

Even though the wall thickness of the suction cover may moreover be constant over its whole extent, the wall thickness preferably decreases evenly from the foot of the suction cup adjacent to the bottom wall of the suction cup to the peripheral rim of the suction cup.

For manufacturing reasons the holding recess in the container wall is preferably formed without undercuts, so that the whole recess in the container wall for the receiving trough and the holding recess can be formed without undercuts. With such a design of the holding recess, free of undercuts, the suction cup can also be formed without undercuts and can be glued into the holding recess. The holding recess may be very flatly shaped so as to essentially have a centering effect for attaching the suction cup and to prevent a shearing off of the bonding layer.

The suction cup, which according to the invention is made of soft rubber or soft plastics, is preferably kept in place by a cover foil when it is in its spread-out packing position. The cover foil can cover the whole container or even several containers stacked together according to the invention. However, it is also possible to provide the cover foil in form of a sticker which is placed on the spread-out suction cup and the area of the container wall surrounding the receiving trough and which can be provided with a bar code or another type of imprint.

A container formed according to the invention is also very suitable for being used when travelling, because here, too, the suction cup can be maintained in its spread-out state by means of a common adhesive foil or a common adhesive tape. In this way the container, for example a shower gel bottle, can be easily taken along on trips and, after removing the adhesive foil, can again be attached to a smooth surface and be used again without it being necessary to carry separate suction cups along.

Figure 3:
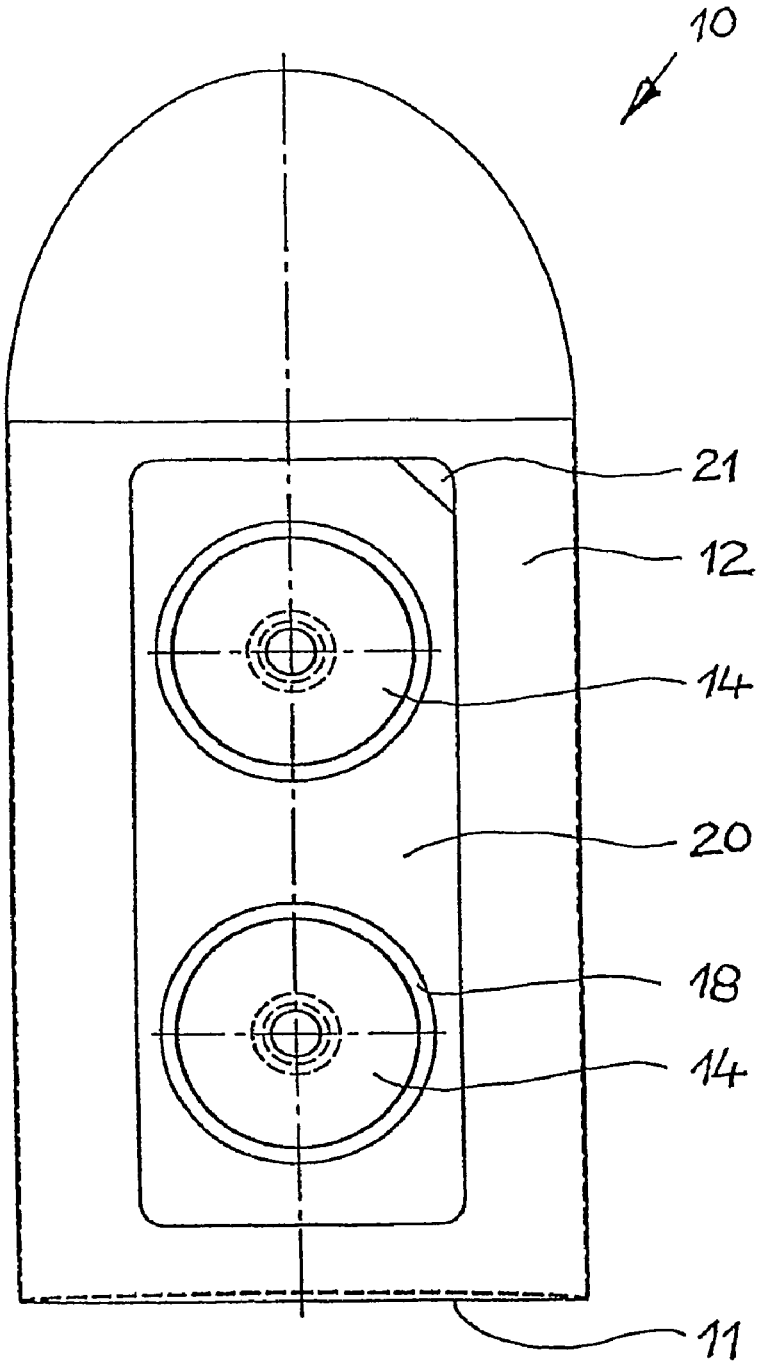
Figure 5:
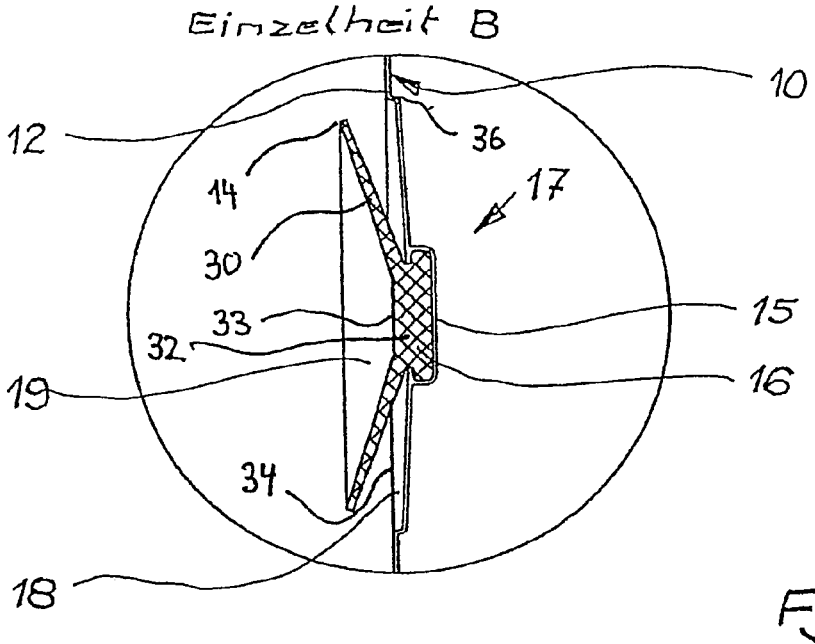
Figure 4:
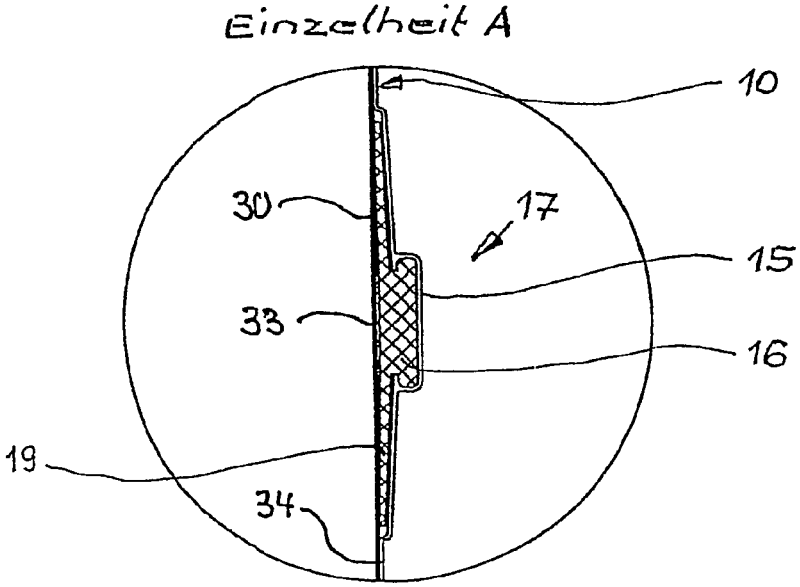
Figure 7:
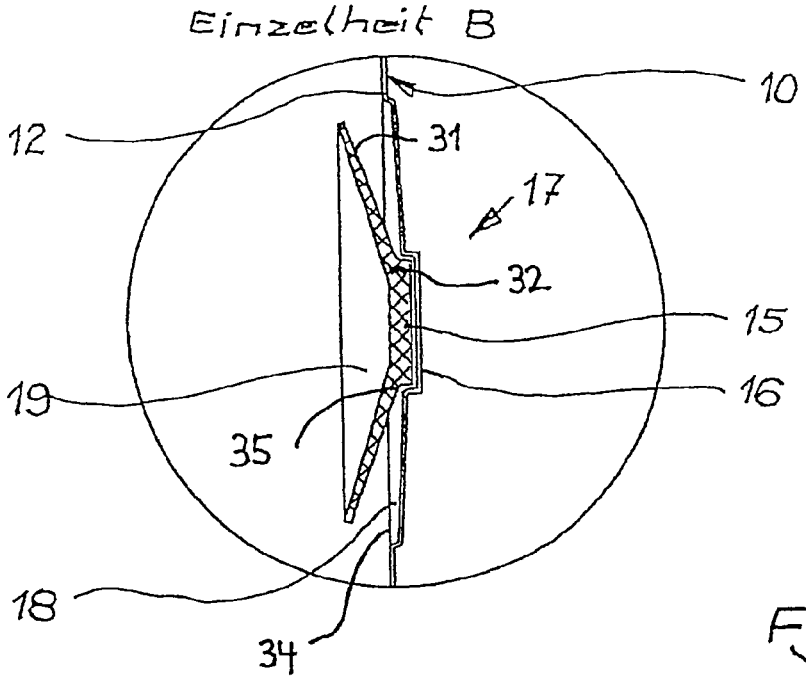
Figure 6:
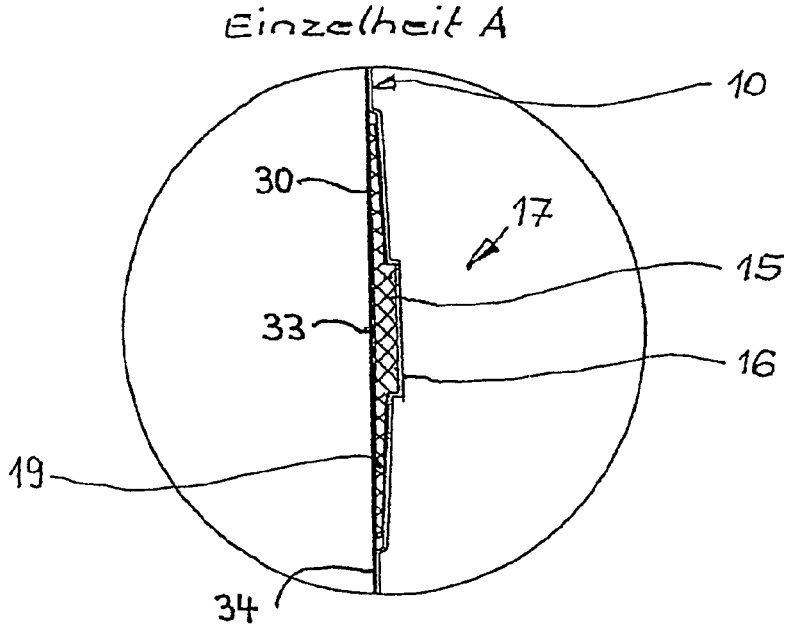
Figure 9:
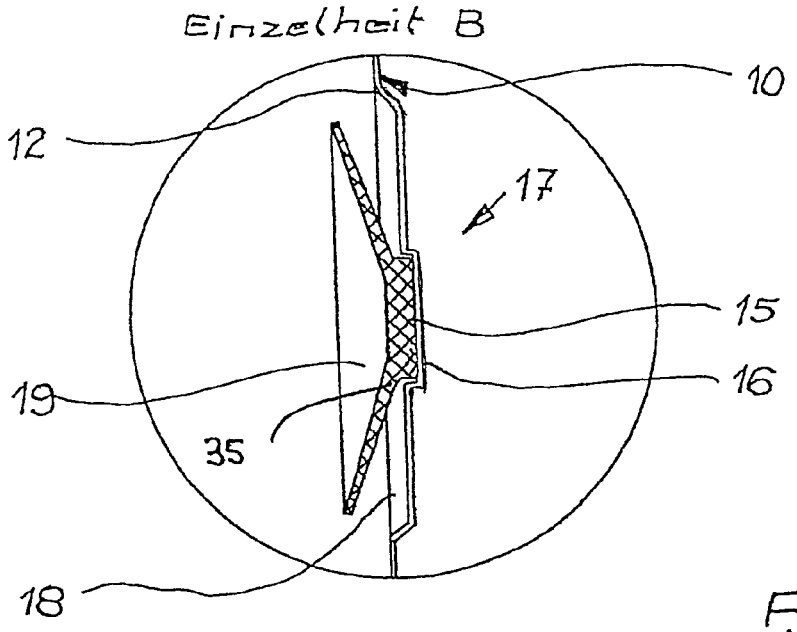
Figure 8:
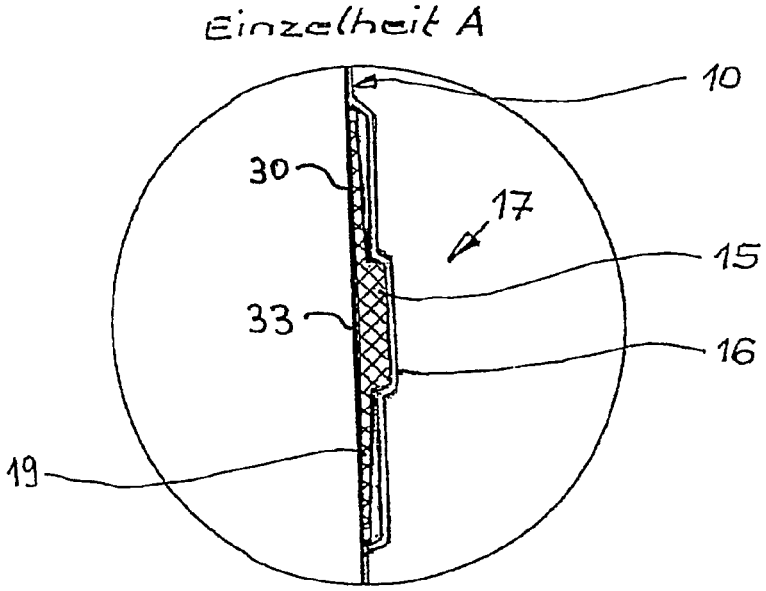
Figure 11:
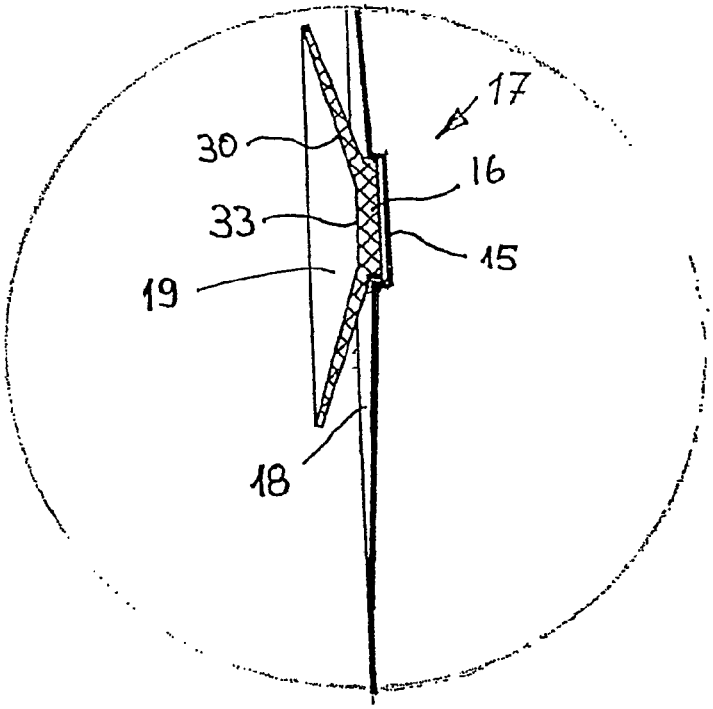
Figure 10:
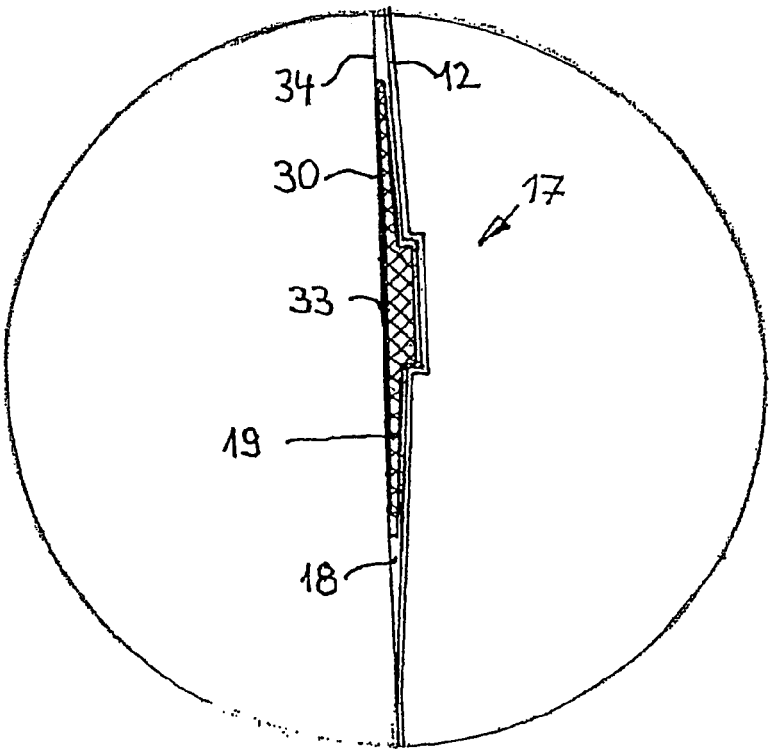
Figure 12:
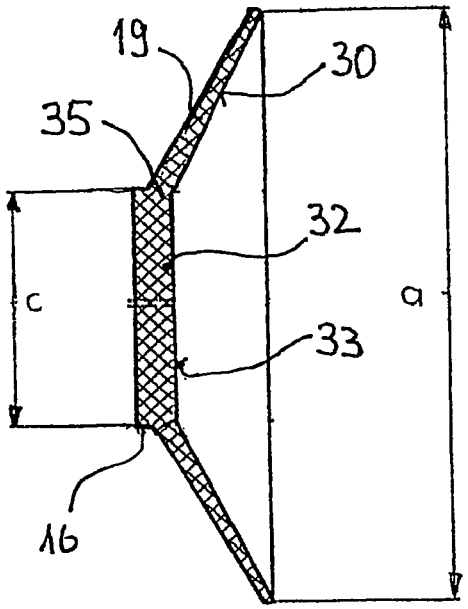
Figure 13:
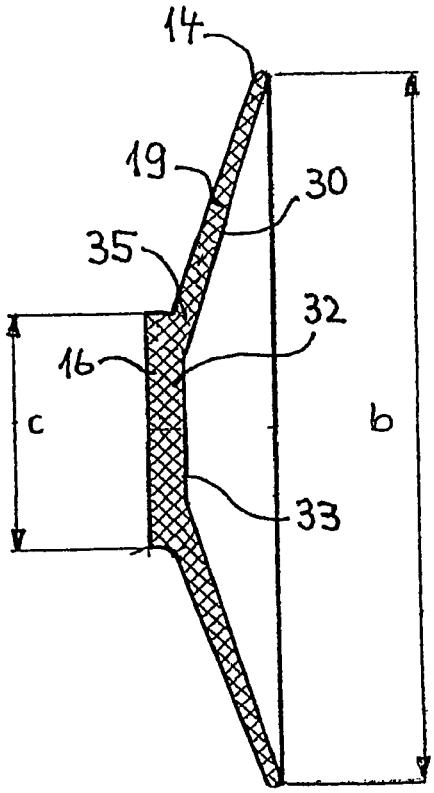

By means of the embodiments shown on the drawings the invention is described and explained in detail. The drawing shows in:

FIG. 1 a container according to the invention in an unattached state in a diagrammatic side view, not true to scale, partly as a sectional view, FIG. 2 the container according to FIG. 1 in an attached state in a diagrammatic side view, not true to scale, partly as a sectional view, FIG. 3 the container according to FIG. 1 in a diagrammatic representation, not true to scale, seen from front, FIG. 4 a detail A of the container according to FIG. 1 in an enlarged representation, FIG. 5 a detail B of the container according to FIG. 2 in an enlarged representation, FIG. 6 a further embodiment according to the detail A according to FIG. 1 in an enlarged representation, FIG. 7 the detail B according to FIG. 2 in an enlarged representation for the embodiment shown in FIG. 6, FIG. 8 an additional embodiment according to the detail A according to FIG. 1 in an enlarged representation, FIG. 9 the detail B according to FIG. 2 in an enlarged representation for the embodiment shown in FIG. 8, FIG. 10 a further embodiment according to the detail A according to FIG. 1 in an enlarged representation, FIG. 11 the detail B according to FIG. 2 in an enlarged representation for the embodiment shown in FIG. 10, and FIGS. 12 and 13 each a suction cup according to the invention in an enlarged representation with different measurements.

The embodiment shown in the drawing by FIGS. 1 to 3 shows a container 10 for receiving for example a shower gel, a shampoo or the like which can be used in bath rooms or toilets. Containers of this kind are made of plastic and are economically manufactured by means of plastic injection moulding or blow moulding.

As it is known, such containers have a small-sized bottom 11 on which they stand and are therefore not very stable but have a tendency to topple over or fall to the ground.

These disadvantages are removed by the container 10 according to the invention. For this purpose, one wall of the container 10, in case of the embodiment in the front wall 12, is provided with two holding elements in form of suction cups 13 which are arranged one above the other. The number of suction cups 13 attached to the container wall 12 may vary and is chosen depending on the size and the weight of the container. In the most simple case, only one suction cup is integrated into the container wall.

The suction cup provided in and attached to the container wall 12 is made of flexible material. A recess 17 is formed in the container wall 12, said recess having a holding recess 15 and a receiving trough 18, said receiving trough being positioned coaxially with and around the recess. A holding projection 16 of the suction cup 14 is kept in the holding recess 15, for example by gluing it on or by providing the side walls of the recess 15 with an undercut into which the holding projection 16 engages. The suction cover 19 of the suction cup 14 is placed into the receiving trough 18 during the non-attached state of the container 10.

In order to avoid that the suction cover 19 protrudes from the container wall 12 when the container is not attached, but instead forms a flush surface with the outside of the container wall 12, a peel-off cover foil 20 is stuck on the outside of the container wall 12 over the area of the receiving trough 18 and the suction cup 13.

This measure facilitates both packing and transporting as well as selling the container 10.

After peeling the cover foil 20 off the container wall 12, for which purpose a strap 21, not stuck to the container wall 12, is provided on the cover foil 20 for facilitating the peeling-off, the suction cups 19 are raised and now protrude from the container wall 12. In this position the container 20 can be securely attached to a wall surface by pressing it against said surface. The container can now no longer topple over or fall down from its place.

On the other hand, the container 10 is easily removable from the wall surface, for example in order to be taken along when travelling. For this purpose, the suction cups 13 can be pushed back into and kept in place in the recess 17 by sticking the cover foil 20 or any other adhesive tape on again. For storing purposes and placing the container in readiness, the cover foil can be stuck on the back wall of the container 10 while it is in an attached state, as this is shown by broken lines in FIG. 1.

As shown in particular by the embodiments according to the details A and B in FIGS. 1 and 2, the suction cup has a suction cover 19 which projects over the contour 34 of the container wall 12 when in used state, the opening angle of said suction cover having an angular degree of 120 to 150, and a bottom wall 32 at the back of which a holding projection 16 is formed. In the preferred embodiment the suction cover 19 has a hollow cone-shaped inside 30 and a cone-shaped outside 31, and the circular inside 33 of the bottom wall 32 is plane. The wall thickness of the suction cover 19 decreases steadily from the circumference of the inside 33 of the bottom wall to the free peripheral rim 14 of the suction cover.

The receiving trough 18 around the holding recess 15 in the container wall 12 is flat and adapted to the thickness of the suction cover 19 and has a size which at least corresponds to the size of the suction cover 19 when said suction cover is pushed flat into the receiving trough, which can be seen from each of the details A. As the holding recess is set back by approximately the thickness of the bottom wall 32 of the suction cup from the contour 34 of the container wall, the bottom wall 32 is also embedded in the receiving trough 18. When the contour 34 of the container wall 12 runs along a plane surface, in its packing state the suction cover 19 spreads into the receiving trough to the extent that the insides 30, 33 of the suction cover 19 and the bottom wall 32 also form a common plane surface which essentially corresponds to the plane surface of the contour 34 of the container wall 12.

The invention can also be applied when the outside of the container wall 12 is slightly convex. In this case the suction cover 19 can be spread-out such as to correspond along its inside in all radial cuts of the suction cup with the respective contour of the container wall and is therefore convex in the embodiment in correspondence with the outside.

In the embodiment according to FIGS. 4 and 5 the holding recess 15 and the holding projection 16 each have an undercut so that the suction cup is kept in the holding recess by its holding projection in a form-fitting way. In the embodiments according to FIGS. 6 to 10, however, the holding projection is cylindrical and the holding recess 15 is hollow-cylindrical or slightly conically extended towards its peripheral outer edge. In this case the holding projection is glued into the holding recess.

Moreover, in these embodiments the holding projection and accordingly the holding recess are relatively flat-shaped. In particular, the bottom wall 32 of the suction cup projects over the circular foot 35, adjacent to the bottom wall, of the suction cover 19 with its side facing away from the inside 33 and forms the holding projection 16 with its protruding sectional portion. The height of the holding projection 16 and correspondingly the depth of the holding recess 15 can be half as thick as the bottom wall, whereby the height of the holding projection may be slightly less than the depth of the holding recess.

Further, with the embodiment according to FIGS. 6 and 7, the depth of the receiving trough 18 decreases radially towards the outside in correspondence with the decrease in thickness of the suction cover, the peripheral rim 36 of the receiving trough only being bigger than the peripheral rim of the spread-out suction cover 19 by a small play. The latter is also the case with the embodiment according to FIGS. 8 and 9, the receiving trough, however, having an essentially constant depth.

With the embodiment according to FIGS. 10 and 11 the depth of the receiving trough 18 also decreases radially towards the outside in correspondence with the decrease in thickness of the suction cover 19, so that it has a hollow cone-shaped bottom. With this embodiment, however, the receiving trough 18 radially projects over the peripheral rim of the spread-out suction cover until it engages into the external contour of the container wall 12 along a concave edge.

FIGS. 12 and 13 show two suction cups according to the invention, wherein the peripheral rim 14 of their respective suction cover 19 has different external diameters. Their flat cylindrical holding projection 16, however, has the same relatively big diameter c with both embodiments. The ratio a:c that the diameter of the holding projection 16 bears to the peripheral rim 14 of the suction cover 19 is two to two and a half with the smaller suction cup according to FIG. 12, and three to four with the bigger suction cup according to FIG. 13.

The invention claimed is:

1. A container made of plastics, comprising a container wall provided with at least one suction cup for attaching the container to a wall surface, said suction cup projecting over an external contour of the container wall when being used and having a concave inside formed by inner surfaces of a bottom wall and a suction cover that projects from said bottom wall, which suction cover expands in diameter from the inner surface of the bottom wall and can be elastically flattened, wherein a holding projection is formed on a side facing away from the inner surface of the bottom wall, said holding projection being fixed in a complementary holding recess in the container wall that has the shape of a blind hole, the suction cover is designed such that it can be flattened into a packing position in which said suction cover is spread-out in a flat receiving trough formed in the container wall around the holding recess, said receiving trough corresponds in its circumferential size at least to the peripheral size of the spread-out suction cover and in its depth to the depth of the suction cover, and the holding recess is set back from the external contour of the container wall so that the inner surfaces of the bottom wall and the spread-out suction cover essentially extend in flush along the external contour of the container wall.

2. In the container according to claim 1, the inside of the suction cover has the shape of a hollow cone cover surface.

3. In the container according to claim 1, the wall thickness of the suction cover decreases from the bottom wall to a free peripheral rim of the suction cover.

4. In the container according to claim 3, the depth of the receiving trough decreases from a rim of the holding recess towards its peripheral rim in correspondence with the decrease in depth of the suction cover.

5. In the container according to claim 1, the holding recess comprises the shape of a hollow cylinder without undercuts and the holding projection is cylinder-shaped and glued into the holding recess.

6. In the container according to claim 5, the ratio between a diameter of the holding projection and a diameter of a peripheral rim of the suction cover ranges from 1:2 to 1:4, preferably from 1:2.5 to 1:3.

7. In the container according to claim 1, the bottom wall of the suction cup projects by a projecting part over the adjacent foot of the suction cover with its side facing away from the inner surface, and the holding projection is formed by the projecting part of the bottom wall.

8. In the container according to claim 7, the depth of the holding recess corresponding at most to half of the thickness of the bottom wall.

9. In the container according to claim 2, an opening angle of the suction cover is 120 to 150 degrees.

10. In the container according to claim 1, a peripheral rim of the receiving trough corresponds to a peripheral rim of the spread-out suction cover.

11. In the container according to claim 1, the suction cup with its spread-out suction cover is kept in place within the receiving trough by a cover foil placed on an exterior surface of the container.

12. In the container according to claim 11, the cover foil is an adhesive tape that is removably attached to the container wall.

* * * * *